US009291136B2

(12) United States Patent
Short et al.

(10) Patent No.: US 9,291,136 B2
(45) Date of Patent: Mar. 22, 2016

(54) FUEL INJECTOR WITH A TRIMMABLE HEATER AND AN INCREASED HEATER CONTACT AREA

(71) Applicant: DELPHI TECHNOLOGIES, INC., Troy, MI (US)

(72) Inventors: Jason C. Short, Webster, NY (US); John K. Isenberg, Rossville, IN (US); Bradley H. Carter, Kokomo, IN (US); Cynthia J. Baron, Fairport, NY (US); Scott A. Williams, Kokomo, IN (US); Otto Muller-Girard, Jr., Rochester, NY (US)

(73) Assignee: Delphi Technologies, Inc., Troy, MI (US)

( * ) Notice: Subject to any disclaimer, the term of this patent is extended or adjusted under 35 U.S.C. 154(b) by 165 days.

(21) Appl. No.: 14/104,144

(22) Filed: Dec. 12, 2013

(65) Prior Publication Data

US 2014/0097269 A1 Apr. 10, 2014

Related U.S. Application Data

(62) Division of application No. 12/870,390, filed on Aug. 27, 2010, now abandoned.

(51) Int. Cl.
*F02M 53/06* (2006.01)

(52) U.S. Cl.
CPC ..... *F02M 53/06* (2013.01)

(58) Field of Classification Search
CPC ..... F02M 53/06
USPC ..... 239/135, 139, 533.2; 60/260; 219/535, 219/543, 544; 29/611
See application file for complete search history.

(56) References Cited

U.S. PATENT DOCUMENTS

| | | | | |
|---|---|---|---|---|
| 3,730,373 | A | 5/1973 | Kozbelt | |
| 3,872,281 | A | 3/1975 | Krieg et al. | |
| 3,912,907 | A | 10/1975 | Lodi et al. | |
| 4,667,084 | A | 5/1987 | Regge et al. | |
| 4,725,713 | A | 2/1988 | Lehrke | |
| 2014/0284398 | A1 * | 9/2014 | Kabasin | F02M 53/06 239/132 |

* cited by examiner

*Primary Examiner* — Justin Jonaitis
(74) *Attorney, Agent, or Firm* — Thomas N. Twoney

(57) ABSTRACT

A fuel injector wherein a cylindrical surface supports an electrical heating structure covering 360° or almost 360° of the surface for heating fuel. The structure comprises a first dielectric layer adhered to the surface; a thick film resistance heating element; a second dielectric layer; spaced-apart first and second conductor pads, wherein the first conductor pad is disposed in contact with a dielectric layer and a first end of the heating element, and wherein the second conductor pad is disposed in contact with a dielectric layer and a second end of the heating element. Another dielectric layer may be disposed over the preceding layers and the first and second conductor pads and having first and second windows formed therein for access to the first and second conductor pads. The resistance heating element may selectively be trimmed by overprinting in a pattern one or more times to improve the uniformity of heating.

4 Claims, 5 Drawing Sheets

FUEL INJECTOR WITH A TRIMMABLE HEATER AND AN INCREASED HEATER CONTACT AREA

CROSS REFERENCE TO RELATED APPLICATIONS

This application is a divisional of U.S. patent application Ser. No. 12/870,390 filed on Aug. 27, 2010, the disclosure of which is incorporated herein by reference in its entirety.

TECHNICAL FIELD OF INVENTION

The present invention relates to fuel injectors for internal combustion engines; more particularly, to fuel injectors incorporating heating elements disposed around the barrel end of the injector for heating fuel prior to injection; and most particularly, to an improved fuel injector having a resistance heating element covering a greater barrel surface area and whose resistivity may be controllably adjusted by the selective application of additional layers of heater element.

BACKGROUND OF INVENTION

It is known that, during a cold start of an internal combustion engine equipped with fuel injectors, the first few combustion cycles contribute a significant amount of hydrocarbons during an emissions test cycle. It is also known that if fuel is heated before it exits the tip or barrel end of a fuel injector, atomization of fuel is improved through smaller droplet size. This improvement in atomization allows for more complete combustion, which results in lower emissions and increased fuel economy.

In order for the initial pulses of fuel from the fuel injector to be heated, the heat source must be able to heat the fuel that resides just upstream of the metering valve in the barrel end of the injector. In one prior art example, it is known to cover the outside of a fuel injector barrel over a portion of its circumferential surface with a thick film resistance heating element. However, in the known art, a measurable gap along the adjacent axial edges of the heating element must be maintained to electrically insulate the opposing poles of the heating element from each other. Therefore, only about 65% of the surface area of the fuel injector barrel may be heated directly by the resistance heating element.

In another prior art example, a resistance heating element formed in a long, narrow strip is wrapped around a fuel injector barrel in a helical path. The connector pads are then bonded to each end of the helix. In this design, since each loop of the helix must be spaced from the adjacent helix loop in order to assure a current flow path through the entire helix, and since the connector pads consume a fair length of the heating element at each end of the helix, the surface area of the fuel injector barrel contacted by the active portion of the heating element is significantly reduced as well.

These arrangements have at least three shortcomings.

First, because the heating element does not come in direct contact with a substantial amount of the fuel injector barrel surface, the fuel injector barrel has non-heated areas. Thus, fuel therewithin is heated non-uniformly. To overcome this, it is known to provide a static mixing element within the barrel to channel cold fuel circumferentially into the heated region during the flow of fuel axially through the barrel and to mix the cold fuel with heated fuel. This solution provides only a marginal improvement and adds significant cost, complexity, and bulk to a fuel injector with this design.

Second, the resistance element typically is applied in a single "thick" coating and for various reasons a typical coating may vary in thickness, and consequent resistance, by about 20%. In order to reduce areal variability in heating, it is known to trim thick film heaters by laser, by partially cutting into the surface of the resistance element in selected locations. However, the cuts into the surface weaken the integrity of the heater film, with possible cracking, and provide points where contamination may be collected, either or both potentially causing heater element failure.

Third, depending upon the fuel injector's heater design, relatively small hot spots can occur in the resistance heater, as for example, near cut-outs or islands, which are necessarily provided on the surface of the resistance element or where connector pads attach to the resistance element. These spots result in decreased and non-uniform heat transfer to the fuel. It has been found that these hot spots can be reduced by selectively adding one or more localized layers of resistance coating to the resistance layer.

What is needed in the art is a fuel injector having a thick resistance element on the outside of the barrel wherein coverage of the barrel by the resistance element is optimized and wherein resistance is uniform to within about 5%.

It is a principal object of the present invention to improve the uniformity of fuel heating during passage of fuel through a fuel injector barrel.

SUMMARY OF THE INVENTION

Briefly described, an improved fuel injector in accordance with the present invention comprises a resistance heating element coated on substantially the entire circumferential surface of the cylindrical fuel injector barrel. Connections for the connector pads are provided on the very edges of the resistance heating element so as to maximize the area of contact between the heating element and the injector barrel. In one aspect of the invention, the coating is trimmed, or is selectively made as a plurality of layers, each of which may be varied in thickness areally to provide a total coating having resistance uniformity superior to that available in the prior art. The coating may be altered in this manner in any regions to provide greater or lesser heating as may be desired. In one aspect of the invention, the resistance heating element is engaged at its first and second axial ends by first and second conductor pads, respectively, such that current flows axially through the resistance element. In another aspect of the invention, the resistance heating element is engaged at its first and second radial ends by first and second conductor pads, respectively, such that current flows circumferentially through the resistance element. The invention may obviate the need for a static mixing element, and offers a more robust way of trimming the resistance characteristics of the resistance element as required.

BRIEF DESCRIPTION OF DRAWINGS

The present invention will now be described, by way of example, with reference to the accompanying drawings, in which.

Corresponding reference characters indicate corresponding parts throughout the several views. The exemplifications set out herein illustrates preferred embodiments of the invention, and such exemplifications are not to be construed as limiting the scope of the invention in any manner.

DETAILED DESCRIPTION OF INVENTION

Figure 1:
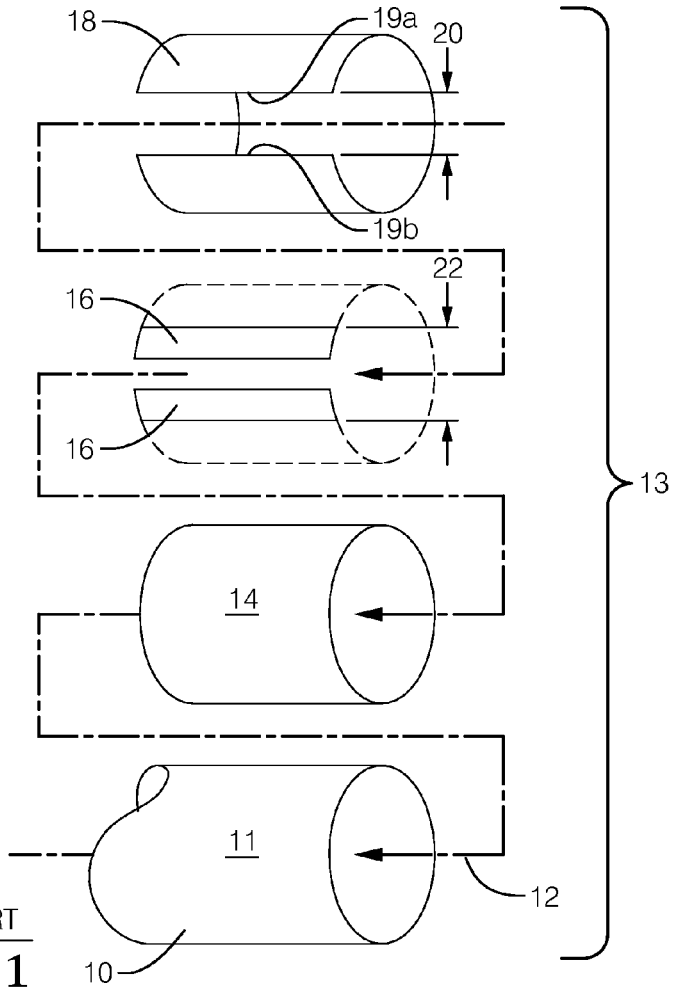
PRIOR ART FIG. 1
FIG. 1 is an exploded isometric view of a prior art electrical heating resistance structure of a heated fuel injector.

Referring to FIG. 1, a tip portion 10 for conducting a heatable media such as fuel through a prior art fuel injector, herein referred to as an injector barrel, is shown. Above injector barrel portion 10 are shown separate layers of material applied in sequence onto barrel 10 to form electrical heating resistance structure 13. Each layer is applied in succession such as, for example, by screen printing. Barrel 10, having an axis 12 comprises a metal substrate 11 forming the barrel overcoated with a glass dielectric layer 14. Spaced apart conductor pads 16 are applied onto dielectric layer 14. Electrical resistance layer 18 is applied over the dielectric layer 14 and over portions of the conductor pads 16 thereby enveloping the barrel around its circumference except for a gap 20 that is left between the axial edges 19*a*,19*b* of electrical resistance layer 18. In this prior art arrangement, a substantial amount of potential heater surface area is not available for heating due to resistor overlap with the conductor pads and to the gap between the pads, since anywhere the resistance layer is not in contact with the barrel and anywhere the conductor pads are in contact with the resistance layer, heat is not generated. Thus, strip 22 of the barrel is not heated. In the example shown, approximately 25% of the barrel is not in contact with the resistance layer and is unheated.

Figure 2:
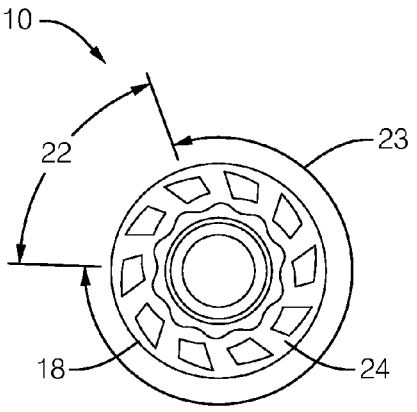
PRIOR ART FIG. 2
FIG. 2 is a cross-sectional view of the injector barrel shown in FIG. 1 (resistance heater omitted for clarity), taken orthogonal to the barrel axis, showing the extent of the non-heated circumferential area in a prior art fuel injector.
Figure 3:
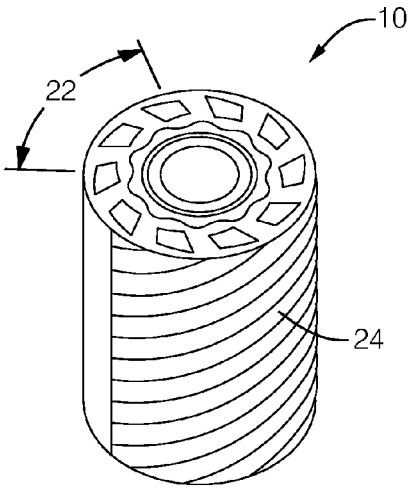
PRIOR ART FIG. 3
FIG. 3 is an isometric view of the interior of the injector barrel shown in FIG. 1, showing the extent of the static mixer required to thermally homogenize fuel flowing through the barrel.

Referring now to FIG. 2, the current flow path 23 through electrical resistance layer 18 is shown. Because heat is generated asymmetrically over only about two-thirds of the circumference of injector barrel 10, fuel passing through the barrel is heated non-uniformly. Therefore, a complex static mixer insert 24 (FIGS. 2 and 3) is provided within barrel 10 to mix the non-heated fuel with the heated fuel before fuel exits the fuel injector.

Figure 4:
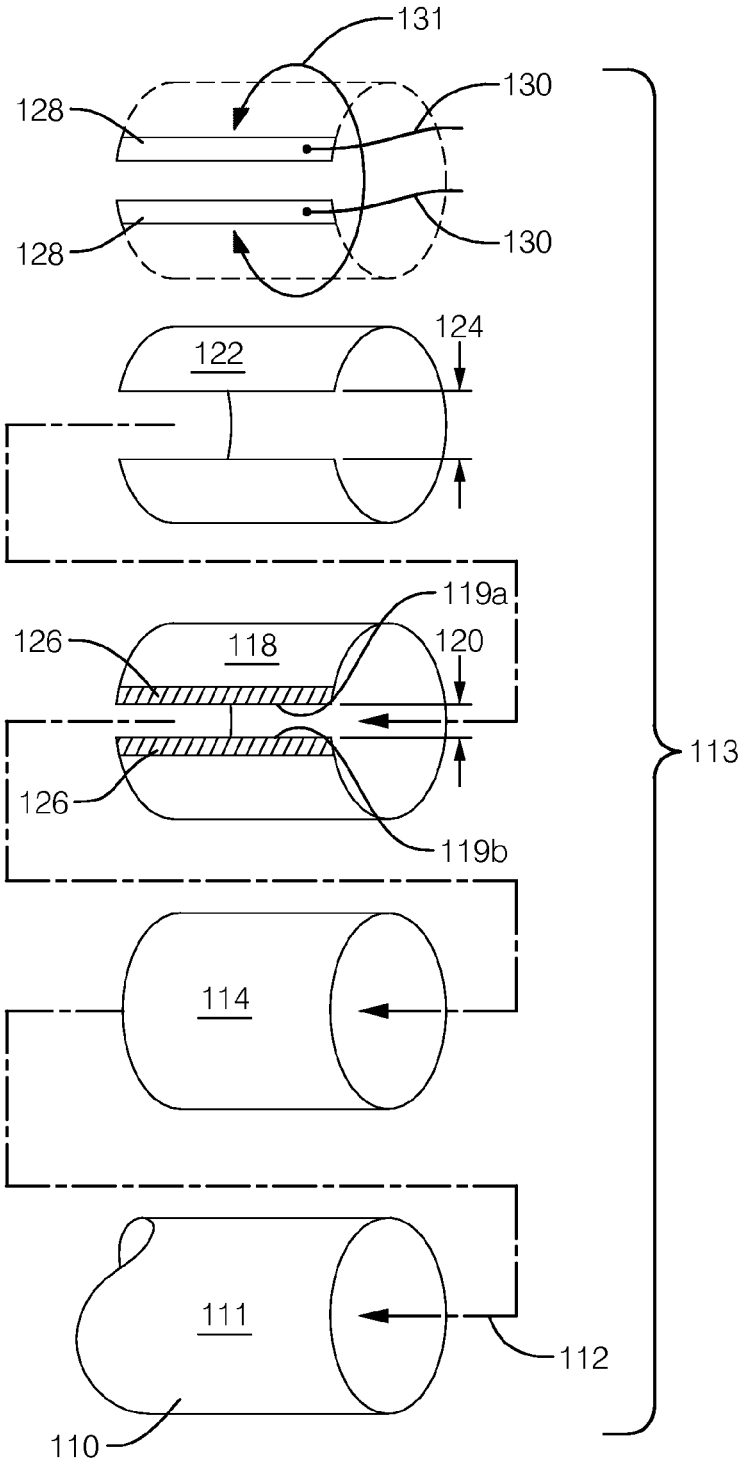
FIG. 4 is an exploded isometric view of a first embodiment of an electrical heating resistance structure in accordance with the invention.

Referring now to FIG. 4, an improved fuel injector barrel 110 of a first embodiment, having axis 112, is shown. Above barrel 110 are shown separate layers of material applied in sequence onto barrel 110 to form electrical heating resistance structure 113. Each layer is applied in succession such as, for example, by screen printing. Barrel 110 comprises a metal substrate surface 111 forming the barrel overcoated with a glass dielectric layer 114. A second dielectric layer (not shown) may be applied on top of dielectric layer 114 to ensure that the substrate is completely covered by the dielectric, without voids. Next, electrical resistance layer 118, which may be applied in multiple trimming layers as described below, is applied over the dielectric layer 114, approximately equal in axial length to the axial length of the dielectric layer but with a narrow gap 120, only wide enough to insulate the opposing poles 119*a*,119*b* of the resistance layer 118. The width of gap 120 in FIG. 4 is exaggerated in size for clarity purposes. Next, another dielectric layer (or two dielectric layers) 122 is applied over resistance layer 118, approximately equal in axial length to the axial length of the previous resistance layer 118 and of dielectric layer(s) 114 but with a gap 124 centrally aligned over gap 120 of the resistance layer 118. With gap 124 being greater than gap 120, and the two gaps centrally aligned, contact bands 126 of resistance layer 118 are left exposed beyond the edges of dielectric layer for attachment by conductor pads 128. Noting that areas of the resistance layer that are in direct contact with the conductor pads do not generate heat, gap 124 in dielectric layer 122 is selected so that the narrow width of exposed contact bands 126 is only wide enough to not limit current flow at the junctures between the conductor pads and the resistance layers. It has been found that the narrow width of the exposed contact bands 126 may be in the range of about 0.2 mm to about 0.3 mm without significantly curtailing current flow. Next, conductor pads 128, preferably of Ag—Pt alloy, are applied to the exposed contact bands 126 of resistance layer 118. Lead wires 130 are then connected to the conductor pads for completion of the electrical circuit. Optionally, an additional localized dielectric layer (not shown) may be applied over the preceding layers for protection of electrical heating resistance structure 113 from outside contamination, leaving at least a portion of connector pads 128 exposed for later connection to the lead wires. In the embodiment shown in FIG. 4, resistance layer 118 (and therefore heater contact) more completely envelops barrel 110 except for small gap 120. Once conductor pads 128 are applied, the effective area of the heat generated by resistance layer 118 may be defined circumferentially as dimension 131 shown in FIG. 4.

Figure 5:
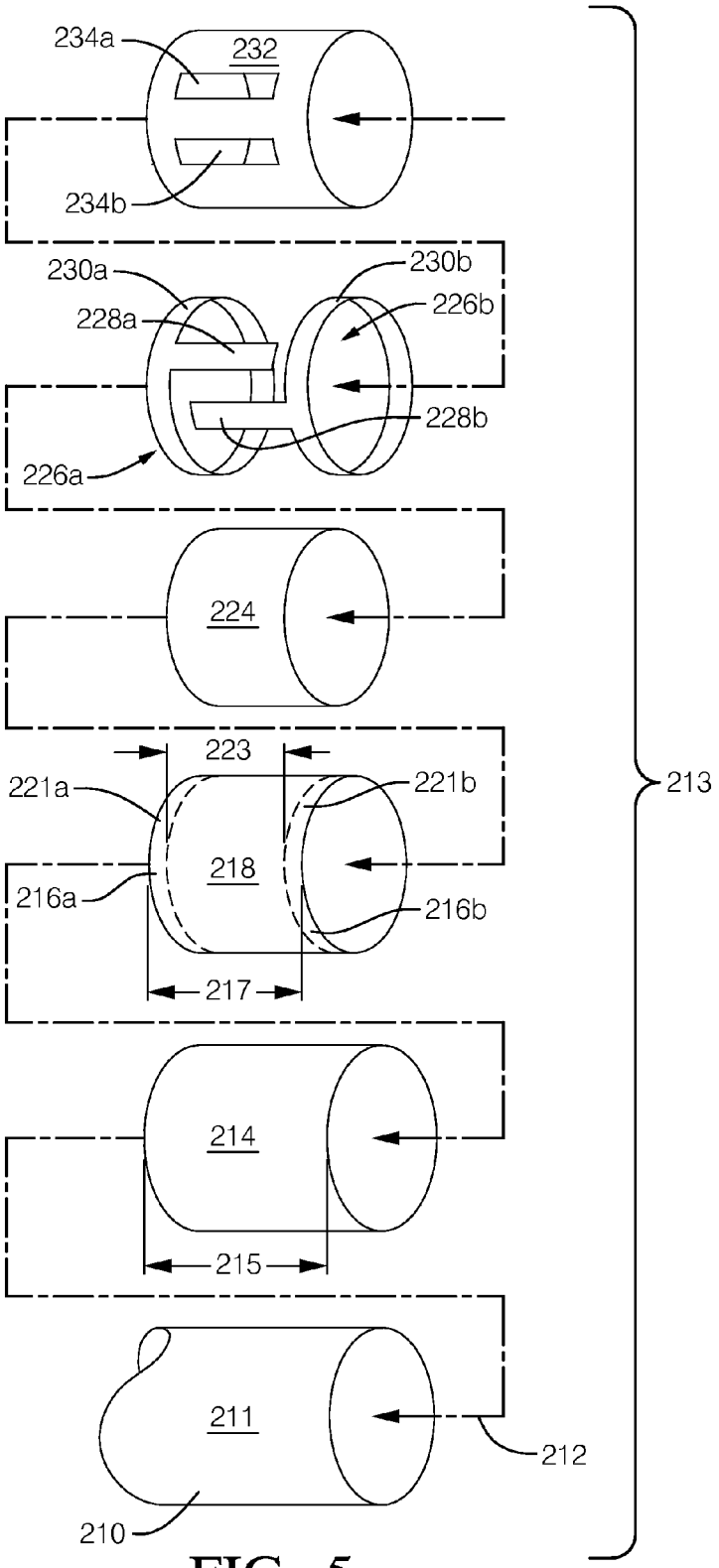
FIG. 5 is an exploded isometric view of a second embodiment of an electrical heating resistance structure in accordance with the invention.

Referring now to FIG. 5, an improved fuel injector barrel 210 of a second embodiment, having axis 212 is shown. Above barrel 210 are shown separate layers of material applied in sequence onto barrel 210 to form electrical heating resistance structure 213. Each layer is applied in succession such as, for example, by screen printing. Injector barrel 210 comprises a metal substrate surface 211. Electrical resistance heating structure 213 applied upon metal substrate surface 211 includes at least one glass dielectric layer 214. A second glass dielectric layer (not shown) may be added to ensure that the substrate surface is completely covered by the dielectric layer without voids. Dielectric layer 214 is coated around injector barrel 210 in a 360° circumferential band at a first width 215. Next, electrical resistance layer 218, which may be applied in multiple trimming layers as described below, is applied centered over the dielectric layer 214, in a 360° circumferential band at a second width 217 slightly narrower than first width 215. In a further step described below, opposing electrical conductor pads 226*a*,226*b* may be attached at the axial ends of the circumferential band of electrical resistance layer 218, thereby providing connection points for an electrical circuit for powering the resistance layer 218. Next, and preferably before opposing electrical conductor pads 226*a*,226*b* are attached, one or more circumferential glass dielectric layers 224 are applied centered over resistance layer 218 at a third width 223 narrower than second width 217, leaving exposed first and second narrow bands 221*a*, 221*b* (shown in dashed lines) defining opposing electrical terminals 216*a*,216*b* of electrical resistance layer 218. The width of these bands may be kept in the range of about 0.2 mm to about 0.3 mm without significantly curtailing current flow. Over dielectric layer 224 are applied first and second conductor pads 226*a*,226*b*. Conductor pads 226*a*,226*b* are formed in an interlocking pattern as shown, preferably of Ag—Pt alloy. Each conductor pad comprises an axially-extending contact element 228*a*,228*b* deposited on top of dielectric layer 224 and a circumferential element 230*a*,230*b* deposited in electrical contact with respective bands 221*a*,221*b* and opposing electrical terminals 216*a*,216*b* of electrical resistance layer 218. Optionally, an outer glass circumferential dielectric layer 232 having first and second windows 234*a*,234*b* may be applied over the entire previous sequence of coatings to seal all but restricted areas of the axially extending contact elements 228*a*,228*b* of the conductor pads visible through windows 234*a*,234*b*. Optional layer 232 serves to protect the surface of resistance layer 218 from outside contamination. When optional layer 232 is used, the windows permit access to and connection of electric leads to the conductor pads during assembly of the fuel injector.

Figure 6:
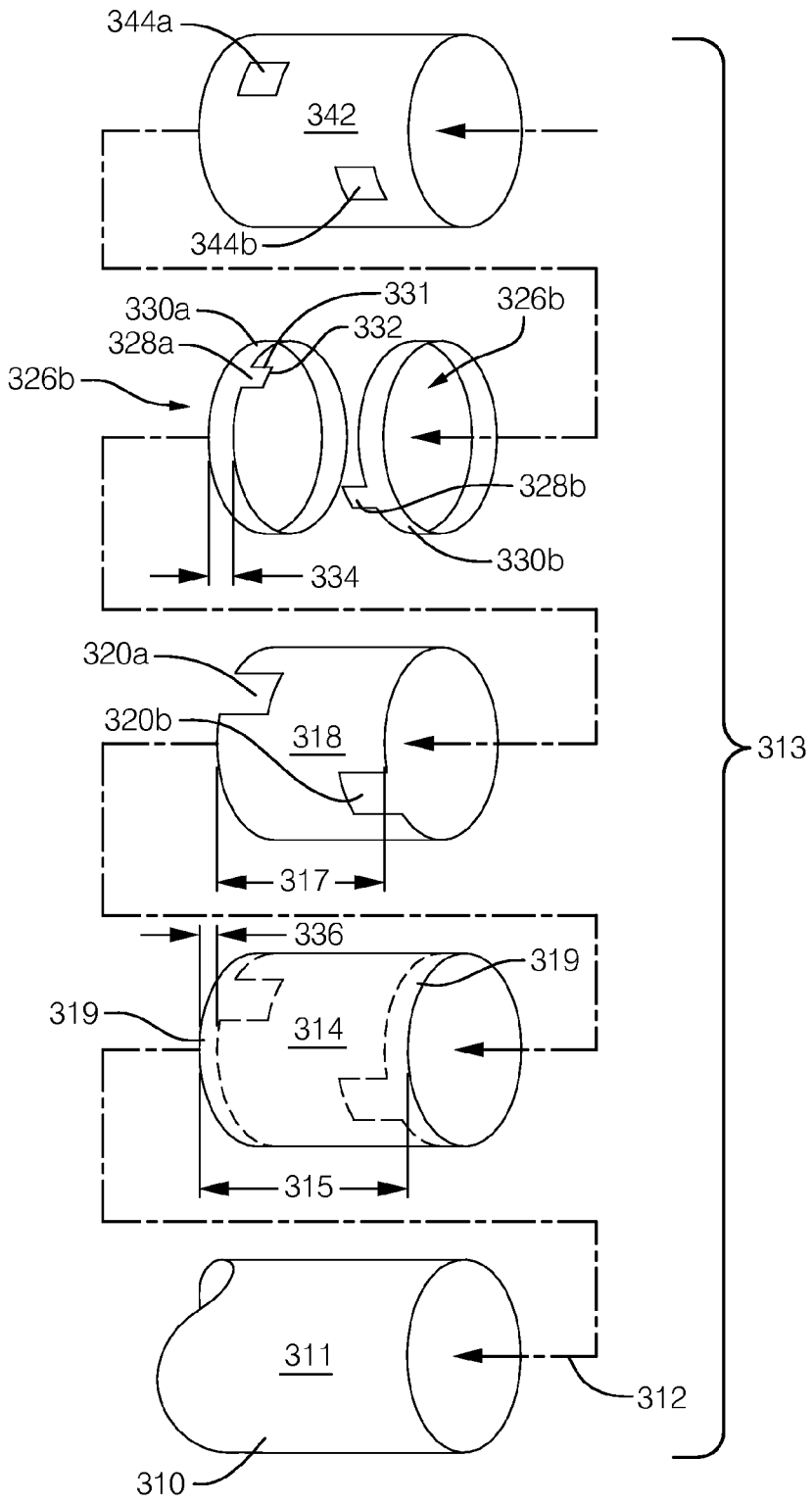
FIG. 6 is an exploded isometric view of a third embodiment of an electrical heating resistance structure in accordance with the invention.

Referring now to FIG. 6, an improved fuel injector barrel 310 of a third embodiment, having axis 312 is shown. Above barrel 310 are shown separate layers of material applied in sequence onto barrel 310 to form electrical heating resistance structure 313. Each layer is applied in succession such as, for example, by screen printing. Injector barrel 310 comprises a metal substrate surface 311. Electrical resistance heating structure 313 applied upon metal substrate surface 311 includes at least one glass dielectric layer 314. A second glass dielectric layer (not shown) may be added to ensure that the substrate surface is completely covered by the dielectric layer without voids. Dielectric layer 314 is coated around injector barrel 310 in a 360° circumferential band at a first width 315. Next, electrical resistance layer 318, which may be applied in multiple trimming layers as described below, is applied centered over the dielectric layer 314, in a 360° circumferential band at a second width 317. Width 317 is slightly narrower than first width 315, resulting in circumferential bands 319 (shown in dotted lines) of exposed dielectric layer 314 beyond the axial ends of resistance layer 318. Each axial end of electrical resistance layer 318 includes a notch 320*a*, 320*b* extending axially inward from the axial end of resistance layer 318 and circumferentially off-spaced from one another. Next, opposing electrical conductor pads 326*a*,326*b*, formed preferably of Ag—Pt alloy, are attached at the axial ends of the circumferential band of electrical resistance layer 318 and are electrically insulated from barrel 310. The axial ends of the circumferential band of electrical resistance layer 318 provide connection points for an electrical circuit for powering the resistance layer 318. First and second connector pads 326*a*,326*b* each include a circumferential element 330*a*,330*b* and axial extending elements shown as tabs 328*a*,328*b* extending axially inward as shown. When attached to the axial ends of electrical resistance layer 318, tabs 328*a*,328*b* are aligned radially so that a gap between sides 331 and end 332 of tabs 328*a*,328*b* remains between the tabs 328*a*,328*b* and the corresponding sides and ends of notches 320*a*,320*b*. Thus, by properly sizing notches 320*a*,320*b* with respect to tabs 328*a*,328*b* and by centrally aligning the tabs with the notches, tabs 328*a*,328*b* may come in contact only with the underlying dielectric layer 314 and only circumferential elements 330*a*,330*b* of conductor pads 326*a*,326*b* are in electrical contact with resistance layer 318. To minimize the area of the resistance layer that comes in direct contact with conductor pads 326*a*,326*b*, the width 334 of circumferential elements 330*a*,330*b*, the width 336 of dielectric layer bands 319 that are exposed beyond the axial ends of resistance layer 318 (shown in dotted lines in FIG. 6) and the axial placement of the conductor pads 326*a*,326*b* over the resistance layer and underlying dielectric layer are selected so that the remaining width of circumferential elements 330*a*,330*b* that are in contact with resistance layer 318 are just wide enough not to limit current flow at the junctures between the conductor pads and the resistance layer. It has been found that the narrow width of the exposed edges 319 that remain in contact with the circumferential elements of the conductor pads may be in the range of 0.2 mm to 0.3 mm without significantly curtailing current flow. Optionally, an outer circumferential dielectric layer 342 having first and second windows 344*a*,344*b* may be applied over the entire previous sequence of coatings to seal all but restricted areas of the axially extending contact elements 328*a*,328*b* of the conductor pads visible through windows 344*a*,344*b*. Optional layer 342 serves to protect the surface of resistance layer 318 from outside contamination. When optional layer 342 is used, the windows permit connection of electric leads to the conductor pads and to the opposing terminals of the electrical resistance layer during assembly of the fuel injector.

In the prior art, electrical resistance layer 18 (FIG. 1) is applied in a single thick coating. For various reasons, the coating may vary in thickness, once applied. Consequently, the layer's resistive characteristics and therefore its heating capability may vary accordingly. In the prior art, the resulting coating may be "trimmed" in order to bring the resistance layer into target. In the prior art, trimming was achieved by cutting partially into the surface of the resistance layer by laser. Typically, the cuts are made into the surface parallel with the current flow path. In the prior art embodiment shown in FIG. 1, since current flows circumferentially and perpendicular to the axis of the barrel, laser cuts were made circumferentially and perpendicular to the axis of the barrel as well.

Figure 7:
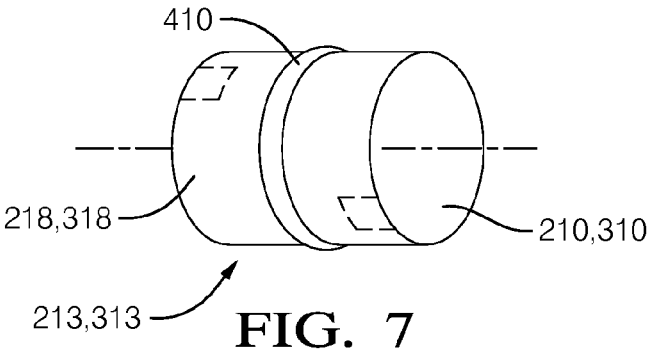
FIG. 7 is a portion of the electrical heating resistance structure shown in FIGS. 5 and 6 showing placement of a resistance layer overprint, in accordance with the invention.
Figure 8:
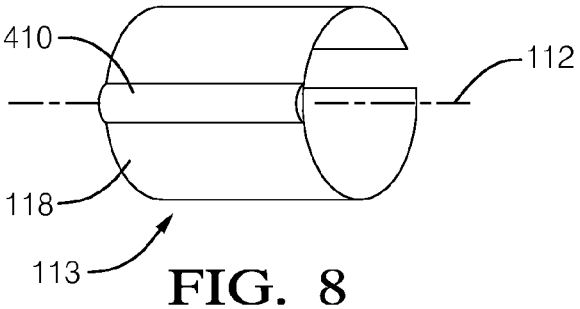
FIG. 8 is a portion of the electrical heating resistance structure shown in FIG. 4, showing placement of a resistance layer overprint, in accordance with the invention.

In accordance with the invention, overprinting instead of laser cutting is used to trim the resistance layer. Overprinting, as used herein, means the application of one or more layers of resistance coating over the preceding layer to adjust the resistance characteristics of the heating element. Electrical resistance layer 118 (FIG. 4), 218 (FIG. 5) and 318 (FIG. 6) may be brought into tolerance by overprinting one or more additional layers of higher-resistivity resistor ink in localized areas, wherein each overprint brings the resistance value closer to aim. The process is complete when the thick film resistor meets a predetermined tolerance. In the case of electrical heating resistance structures 213 (FIG. 5) and 313 (FIG. 6), overprinting 410 of resistance layer 218/318 for trimming purposes would be done along one or more lines running circumferentially in relation to the barrel 210/310 as shown in FIG. 7; in the case of electrical heating resistance structure 113 (FIG. 4), overprinting 410 of resistance layer 118 for trimming purposes would be done along one or more lines of overprint placed parallel to the axis 112 of the barrel as shown in FIG. 8.

The resistance layer overprints can also be used to improve the temperature uniformity of the resistance layer which might be affected by cooler areas near the edges of the resistor, internal fluid flow, irregularities in the thickness of the resistance layer or by placement of the conductor pads. Typically, a prior art thick film resistor may exhibit hot areas, for example, opposite the conductor leads, whereas the lead areas and edges are cooler or near cooler, or near feature cut-outs made in the resistance layer such as notches 320 (FIG. 6).

Overprinting of the resistance layer to bring the resistance layer into tolerance or to compensate for hot areas may be selectively applied based on a known and predetermined heat distribution pattern of the resistance layer of a given type of injector design.

In one method of adjusting the resistance characteristics, the characteristic hot areas of the electrical heating resistance structure of a given injector type may be predetermined by testing of a representative assembled sample of the given injector type. Then, an overprinting pattern of a localized resistance layer applied over the base resistance layer may be developed to attain a target heat distribution across the injector barrel of that injector type. Once an overprinting pattern is developed for a given injector type, that pattern is applied to every injector barrel of that injector type.

A method of this type for adjusting the resistance characteristics includes the steps of:

a. determining a desired target resistance characteristic of an applied electric resistance layer;

b. applying a base electric resistance layer to an actual fuel injector barrel of a given type of fuel injector;

c. determining the resistance characteristic of the applied base electric resistance layer;

d. developing an overprinting pattern of one or more resistance layers applied over the base resistance layer to attain the target resistance characteristic;

e. applying the base resistance layer on each of a plurality of subsequently built fuel injectors of a given type; and f. applying the developed overprinting pattern to each base resistance layer on each of the plurality of subsequently built fuel injectors of a given type.

It is also possible to apply an overprinting pattern in one or more layers unique to a particular fuel injector, depending upon the individual resistance characteristics of the particular fuel injector. It is known that the application of the additional dielectric layer 232, 342 may affect the final resistive characteristics of the heating element of a particular injector. In the embodiment shown in FIG. 5, since the dielectric layer 224 almost completely cover the surface of the electrical resistance layer, a subsequent overprinting of the electrical resistance layer cannot be completed after the dielectric layer is in place. Therefore, an alternate embodiment of the electrical heating resistance structure 213 is necessary if overprinting of patterns unique to a particular injector is needed.

Figure 9:
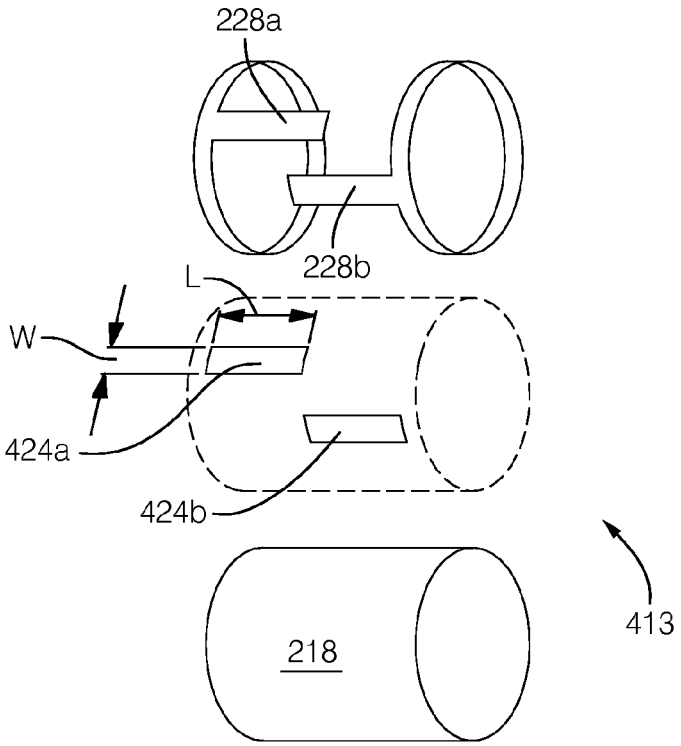
FIG. 9 is a variation of a portion of the electrical heating resistance structure shown in FIG. 5.

Referring to FIG. 9, a portion of electrical heating resistance structure 413 is shown. In this embodiment, all components that are shown are identical to structure 213 shown in FIG. 5 except that dielectric strips 424*a*, 424*b* are used in place of dielectric layer 224. In this embodiment a length L and a width W of the dielectric strips are sized to be only long and wide enough to insulate axial extending contact elements 228*a*,228*b* from the surface of resistance layer 218. Thus, since substantially the entire surface of resistance layer 218 remains exposed after assembly of structure 413, an overprinting operation to the resistance layer 218 could be completed after the final heating characteristics of the heating element in an assembled injector is determined.

A method for adjusting the resistance characteristics of an individual fuel injector includes the steps of:

a. determining a desired target resistance characteristic of an applied electric resistance layer;

b. applying a base electric resistance layer 118, 218, 318 to a fuel injector barrel;

c. completing additional steps of assembly to form an energizable electrical heating resistance layer;

d. determining the resistance characteristic of the applied base electric resistance layer;

e. developing an overprinting pattern of one or more resistance layers applied over the base resistance layer to attain the target resistance characteristic; and f. applying the developed overprinting pattern to the base resistance layer.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

We claim:

1. A method of forming a heating element on a fuel injector and adjusting the resistance characteristics of said heating element including the steps of:

a. determining a desired target resistance characteristic of the heating element of said heated fuel injector;

b. receiving a first fuel injector without a heating element;

c. applying a base electric resistance layer to a barrel of said fuel injector of step b;

d. determining the actual resistance characteristic of the applied base electric resistance layer; and e. applying an overprinting pattern of one or more resistance layers over the base resistance layer to attain the desired target resistance characteristic.

2. The method in accordance with claim 1 wherein, following steps e, the method includes the further step of repeating steps c and e for each subsequently received fuel injector without a heating element.

3. The method in accordance with claim 1 wherein a dielectric layer is applied to the barrel prior to step c.

4. A method of forming a heating element on a fuel and adjusting the resistance characteristics of said heating element including the steps of:

a. determining a desired target resistance characteristic of the heating element of said heated fuel injector;

b. receiving a first fuel injector without a heating element;

c. applying a base electric resistance layer to a barrel of said fuel injector of step b;

d. determining the actual resistance characteristic of the applied base electric resistance layer; and e. applying one or more resistance layers over the base resistance layer to attain the target resistance characteristic.

* * * * *